US007185616B2

(12) United States Patent
Roozenboom

(10) Patent No.: US 7,185,616 B2
(45) Date of Patent: Mar. 6, 2007

(54) GEAR SYSTEM FOR AN INTERNAL COMBUSTION ENGINE

(75) Inventor: Stephan D Roozenboom, Washington, IL (US)

(73) Assignee: Caterpillar Inc, Peoria, IL (US)

( * ) Notice: Subject to any disclaimer, the term of this patent is extended or adjusted under 35 U.S.C. 154(b) by 365 days.

(21) Appl. No.: 10/659,536

(22) Filed: Sep. 10, 2003

(65) Prior Publication Data

US 2005/0051116 A1 Mar. 10, 2005

(51) Int. Cl.
*F02B 75/04* (2006.01)

(52) U.S. Cl. ..... 123/48 B; 123/78 F

(58) Field of Classification Search ..... 123/48 B, 123/78 F

See application file for complete search history.

(56) References Cited

U.S. PATENT DOCUMENTS 3,633,552 A * 1/1972 Huber ..... 123/48 B
4,738,230 A 4/1988 Johnson
6,260,532 B1 7/2001 Mendler
6,443,107 B1 9/2002 Mendler

FOREIGN PATENT DOCUMENTS

FR 2825756 12/2002
GB 363764 12/1931

* cited by examiner

*Primary Examiner*—Noah P. Kamen
(74) *Attorney, Agent, or Firm*—Finnegan, Henderson, Farabow, Garrett & Dunner

(57) ABSTRACT

An internal combustion engine has a cylinder block defining a cylinder. A piston is disposed in the cylinder. The internal combustion engine has a connecting rod connected to the piston and a crankshaft connected to the connecting rod. The internal combustion engine has a vcr mechanism connected to the crankshaft. A first gear is connected to the crankshaft, and a second gear is in mesh with the first gear. The second gear is connected to the vcr mechanism. The internal combustion engine has a third gear in mesh with the second gear. The third gear has a fixed center of rotation.

26 Claims, 6 Drawing Sheets

GEAR SYSTEM FOR AN INTERNAL COMBUSTION ENGINE

This invention was made under a contract with an agency of the United States Government, contract number: DE-FC05-00 OR 22806.

TECHNICAL FIELD

This invention relates generally to an internal combustion engine and more specifically to a gear system of an internal combustion engine.

BACKGROUND

Internal combustion engines are typically designed to operate at optimum efficiency and performance by the selection and design of a desired compression ratio, i.e., a ratio of maximum to minimum cylinder volume, during operating conditions. However, circumstances exist in which it may be desired to change a compression ratio, perhaps dynamically. For example, a compression ratio that may be desired under normal engine run conditions may not be effective during engine start conditions.

Various methods have been devised for varying the compression ratio of an engine. One such method is disclosed in U.S. Pat. No. 6,443,107, issued on 3 Sep. 2002 to Mendler ("the '107 patent"). In the '107 patent the compression ratio of the engine is varied by the use of an eccentric crankshaft cradle. When a change in compression ratio is desired, the eccentric crankshaft cradle rotates, causing the axis of rotation of the crankcase to change position. The axis of rotation of the crankshaft is moved towards or away from a top surface of the cylinder block of the engine, thereby changing the compression ratio of the engine.

One problem faced by internal combustion engines using variable compression ratio mechanisms, such as that in the '107 patent, that change the location of the axis of rotation of the crankshaft is sustaining the crankshaft in a driving relationship with the gear train of the engine. As the crankshaft is moved by the variable compression ratio mechanism, any gear mounted on the crankshaft is moved relative to the other gears of the gear train and the mesh between the gears may not be maintained. Thus, the driving relationship between the crankshaft and the gear train is interrupted.

One attempt to solve the problem of maintaining the mesh between a moving crankshaft and a stationary gear train is disclosed in U.S. Pat. No. 4,738,230, issued to Johnson on 19 Apr. 1988 ("the '230 patent"). In the '230 patent, a spur gear mounted on the crankshaft is meshed with an internal ring gear that is connected to the gear train. As the crankshaft is moved relative to the gear train, the spur gear maintains its mesh with the ring gear by moving in an arc parallel to the ring gear's pitch diameter. The gear system disclosed in the '230 patent is adequate for use on gear trains wherein the relative timing between the crankshaft and other devices driven by the gear train is not important. However, the gear system disclosed in the '230 patent is not capable of use on a gear train that drives a camshaft. As the crankshaft is moved to change the compression ratio of the engine, the crankshaft is also rotated relative to the ring gear. Therefore, the timing relationship between the crankshaft and the camshaft, which is driven by the ring gear, is not maintained. Such a disruption in timing could result in one or more of the valves of the engine colliding with a piston of the engine.

The present invention is directed to overcoming one or more of the problems as set forth above.

SUMMARY OF THE INVENTION

In one embodiment of the present invention, an internal combustion engine has a cylinder block defining a cylinder. A piston is disposed in the cylinder. The internal combustion engine has a connecting rod connected to the piston and a crankshaft connected to the connecting rod. The internal combustion engine has a vcr mechanism connected to the crankshaft. A first gear is connected to the crankshaft, and a second gear is in mesh with the first gear.

The second gear is connected to the vcr mechanism. The internal combustion engine has a third gear in mesh with the second gear. The third gear has a fixed center of rotation.

In another embodiment of the present invention, a gear train for an internal combustion engine has a first gear connected to a crankshaft of the engine. The gear train has a second gear in mesh with the first gear. The second gear is connected to a vcr mechanism of the internal combustion engine. The gear train has a third gear in mesh with the second gear. The third gear has a fixed center of rotation.

In yet another embodiment of the present invention, a method of operating an internal combustion engine includes moving an axis of a crankshaft from a first position to a second position. The method also includes sustaining a driving relationship between the crankshaft and the gear train. The method includes maintaining a timing relationship between the crankshaft and a camshaft of the internal combustion engine.

In a further embodiment of the invention, an internal combustion engine has a cylinder block defining a cylinder. A piston is disposed in the cylinder. The internal combustion engine has a connecting rod connected to the piston and a crankshaft connected to the connecting rod. The crankshaft has an axis. A gear train is connected to the crankshaft, and a camshaft is connected to the gear train. The internal combustion engine has a means for moving the axis of the crankshaft from a first position to a second position. The internal combustion engine also has a means for sustaining a driving relationship between the crankshaft and the gear train. The internal combustion engine has a means for maintaining a timing relationship between the crankshaft and the camshaft.

DETAILED DESCRIPTION

Figure 1:
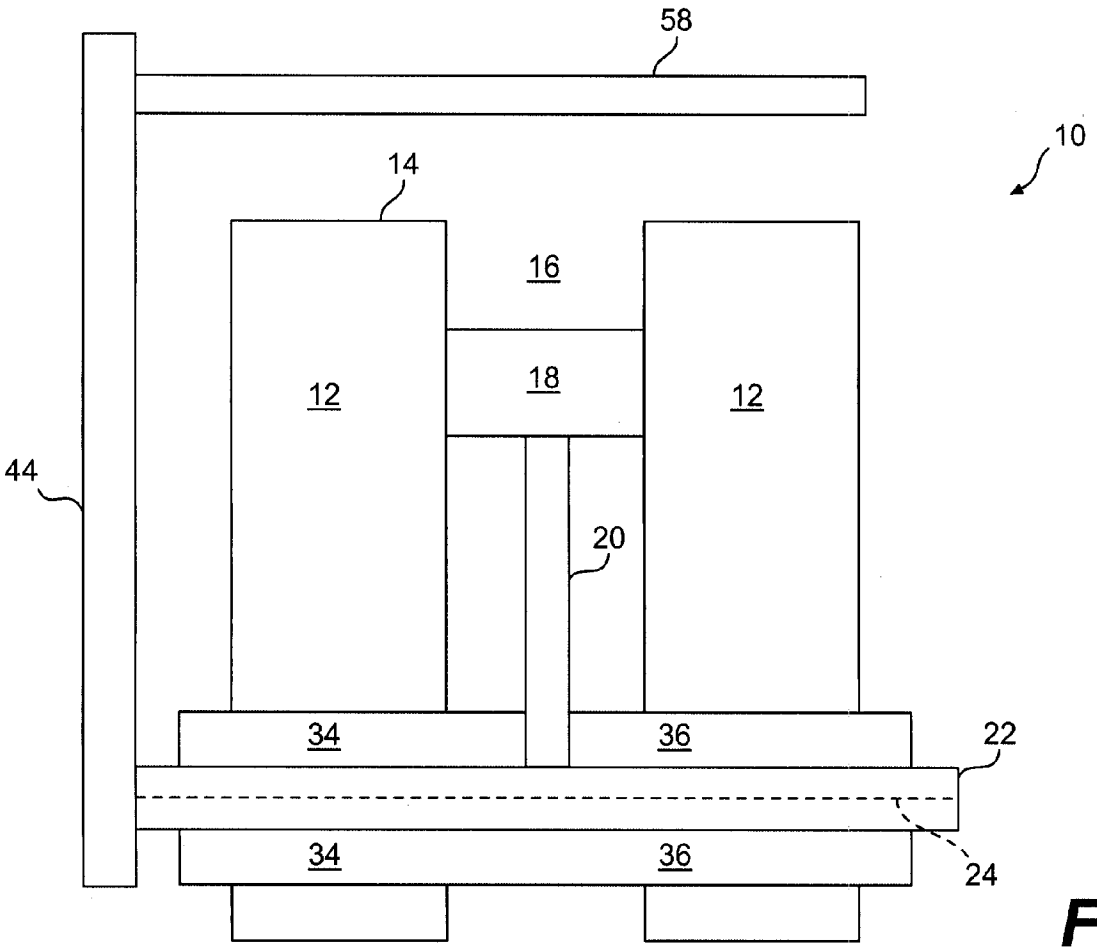
FIG. 1 is a schematic illustration of an internal combustion engine.

Referring to FIG. 1, an internal combustion engine 10 is schematically shown. The engine 10 has a cylinder block 12 having a top surface 14. The cylinder block 12 defines a cylinder 16. A piston 18 is reciprocally disposed within the cylinder 16. A connecting rod 20 is connected to the piston 18, and a crankshaft 22 is connected to the connecting rod 18. The crankshaft 22 has an axis 24. In the embodiment of the engine 10 shown in FIG. 1, the cylinder block 12 has one cylinder 16 and one piston 18. However, the cylinder block 12 may be of any other conventional design, such as "V" or radial, and may have any number of cylinders 16 and pistons 18 equally or unequally spaced.

Figure 2:
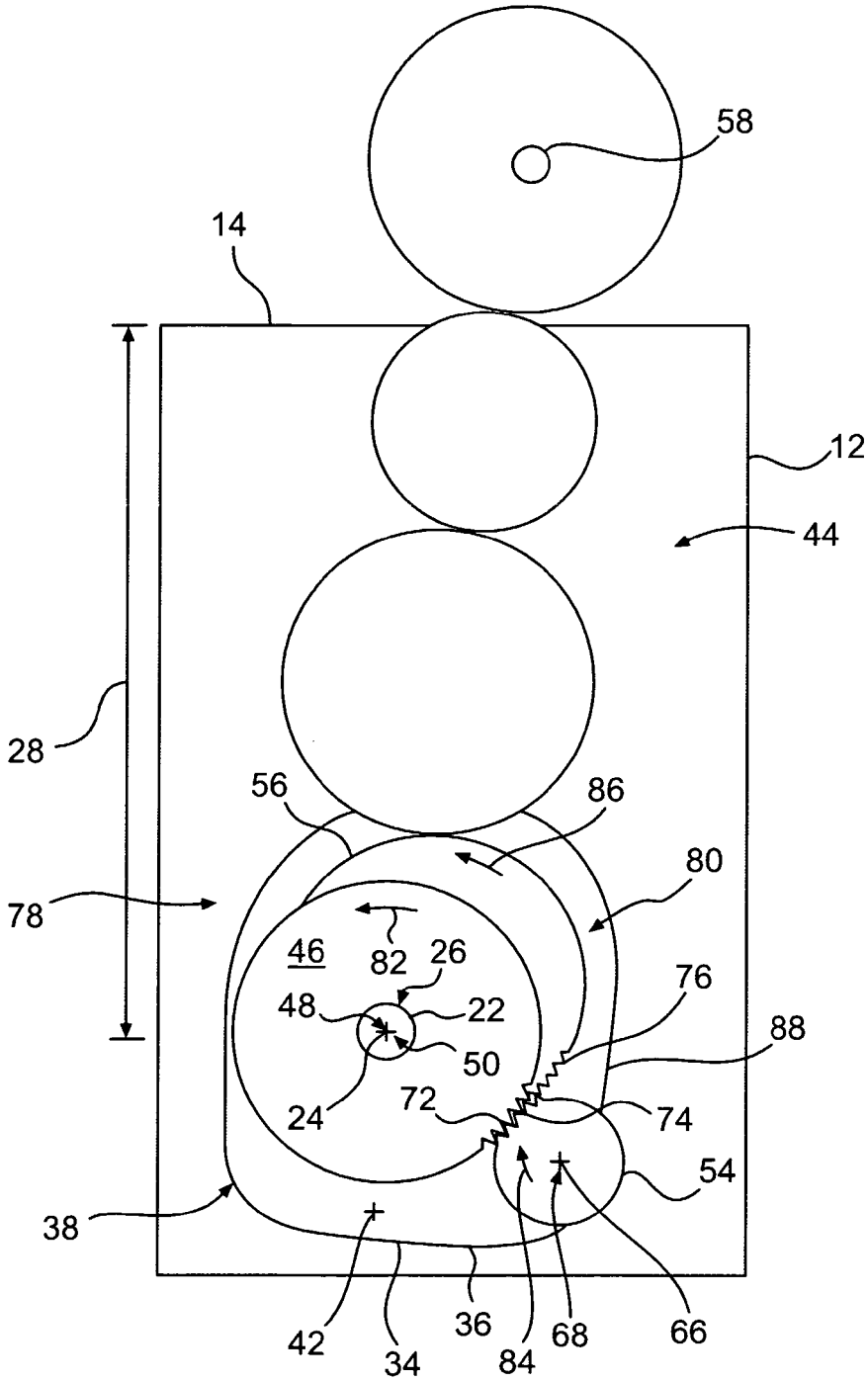
FIG. 2 is a plan view of an embodiment of a gear train of the internal combustion engine of FIG. 1.
Figure 3:
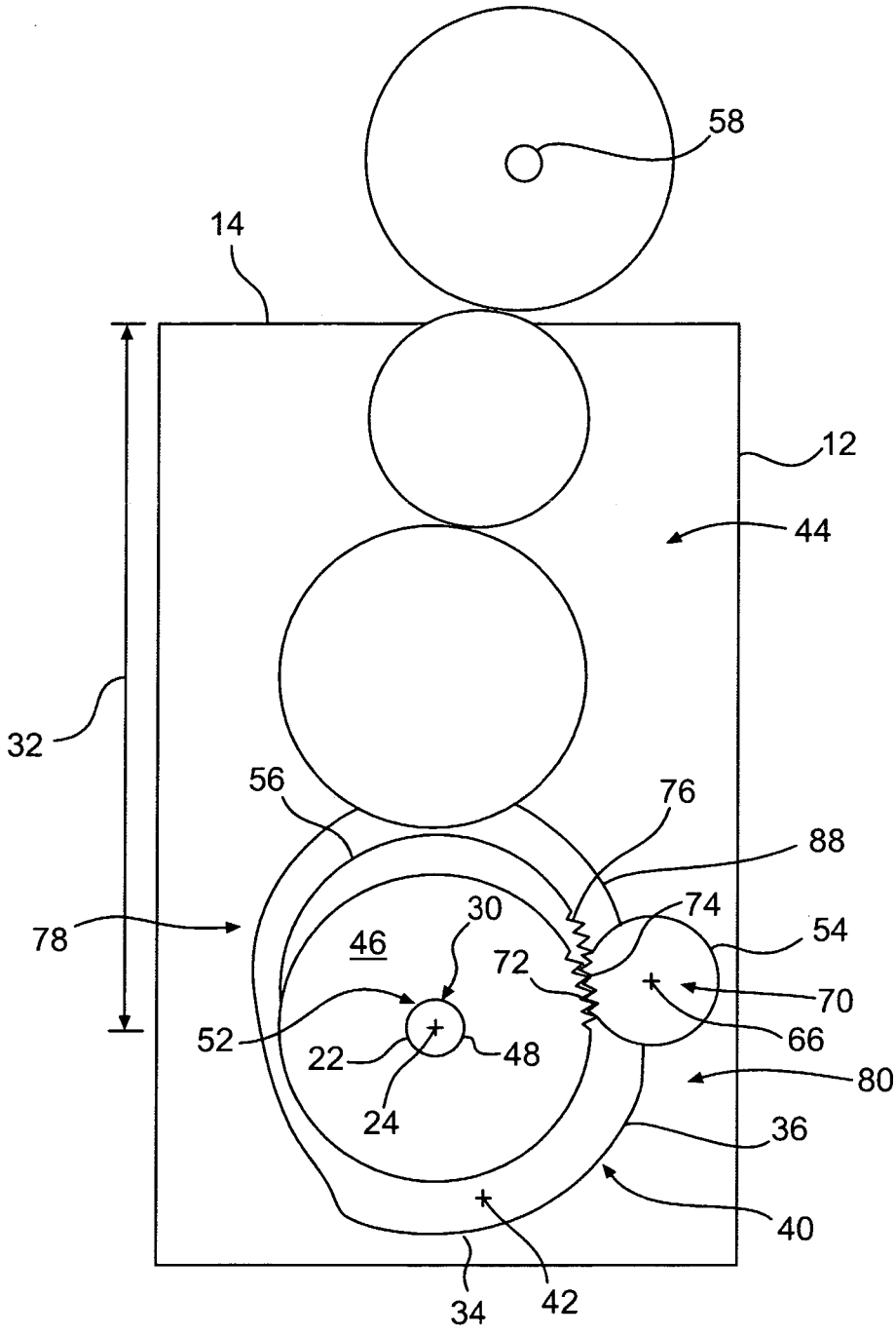
FIG. 3 is a second plan view of the embodiment of the gear train of FIG. 2.

Referring to FIG. 2, the crankshaft 22 is in a first crankshaft position 26 at which the axis 24 of the crankshaft 22 is a first defined distance 28 from the top surface 14 of the cylinder block 12. Referring to FIG. 3, the crankshaft 22 is in a second crankshaft position 30 at which the axis 24 of the crankshaft 22 is a second defined distance 32 from the top surface 14 of the cylinder block 12. The crankshaft 22 is moveable between the first crankshaft position 26 and the second crankshaft position 30. In the embodiment of FIGS. 2 and 3, the first defined distance 28 is greater than the second defined distance 32. Therefore, the compression ratio of the internal combustion engine 10 when the crankshaft 22 is in the first crankshaft position 26 is less than the compression ratio of the engine 10 when the crankshaft 22 is in the second crankshaft position 30.

The internal combustion engine 10 includes a means for moving 34 the axis 24 of the crankshaft 22 from the first crankshaft position 26 to the second crankshaft position 30, shown schematically in FIG. 1. In the embodiment of FIG. 1, the means for moving 34 is a vcr mechanism 36 connected to the crankshaft 22. As used herein, the term "vcr mechanism" means any structure capable of moving the crankshaft 22 from the first crankshaft position 26 to the second crankshaft position 30. The vcr mechanism 36 is moveable between a first mechanism position 38, shown in FIG. 2, at which the crankshaft 22 is in the first crankshaft position 26, and a second mechanism position 40, shown in FIG. 3, at which the crankshaft 22 is at the second crankshaft position 30. The difference between the position of the vcr mechanism 36 in FIG. 2 and FIG. 3 can be seen by the different position of reference point 42 in FIGS. 2 and 3. In the embodiment of FIGS. 2 and 3, the vcr mechanism 36 includes a crankshaft cradle 88. In the embodiment of FIGS. 2 and 3, the vcr mechanism 36 is moveable from the first mechanism position 38 to the second mechanism position 40 by rotation of the crankshaft cradle 88. However, one of ordinary skill in the art will recognize that in other embodiments the vcr mechanism 36 may include other structures and that the vcr mechanism 36 may move from the first mechanism position 38 to the second mechanism position 40 other than by rotation of the vcr mechanism 36.

The engine 10 has a gear train 44 connected to the crankshaft 22, shown schematically in FIG. 1. The gear train 44 includes a first gear 46 connected to the crankshaft 22. In the embodiment of FIG. 2, the first gear 46 is mounted on the crankshaft 22. The first gear 46 has an axis 48. The axis 48 of the first gear 46 is moveable between a first position 50, shown in FIG. 2, at which the crankshaft 22 is at the first crankshaft position 26 and a second position 52, shown in FIG. 3, at which the crankshaft 22 is at the second crankshaft position 30. The gear train 44 also has a second gear 54 that is in mesh with the first gear 46. The second gear 54 is also in mesh with a third gear 56 of the gear train 44 of the engine 10. The third gear 56 has a fixed center of rotation. In the embodiment of FIG. 2, the third gear 56 is operatively connected to a camshaft 58 of the engine 10. In the embodiment of FIG. 2, the third gear 56 does not directly drive the camshaft 58, but drives one or more other gears of the gear train 44, one of which directly drives the camshaft 58. However, in other embodiments, the third gear 56 may directly drive the camshaft 58. In the embodiments shown in FIGS. 2 through 7, the gear train 44 contains spur gears. However, in other embodiments, the gear train 44 may contain other types of gears, including helical gears, worm gears, bevel gears, and straight gears. In addition, in other embodiments, the third gear 56 may drive the camshaft 58 or other components of the engine 10 via a belt or chain.

Figure 4:
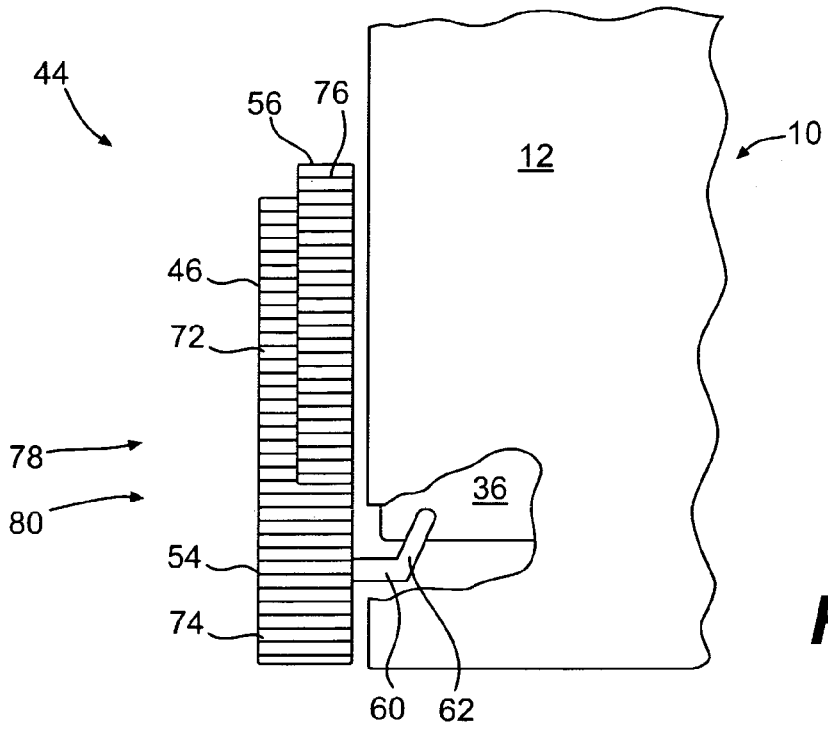
FIG. 4 is a side view of the embodiment of the gear train of FIG. 2 and FIG. 3.
Figure 5:
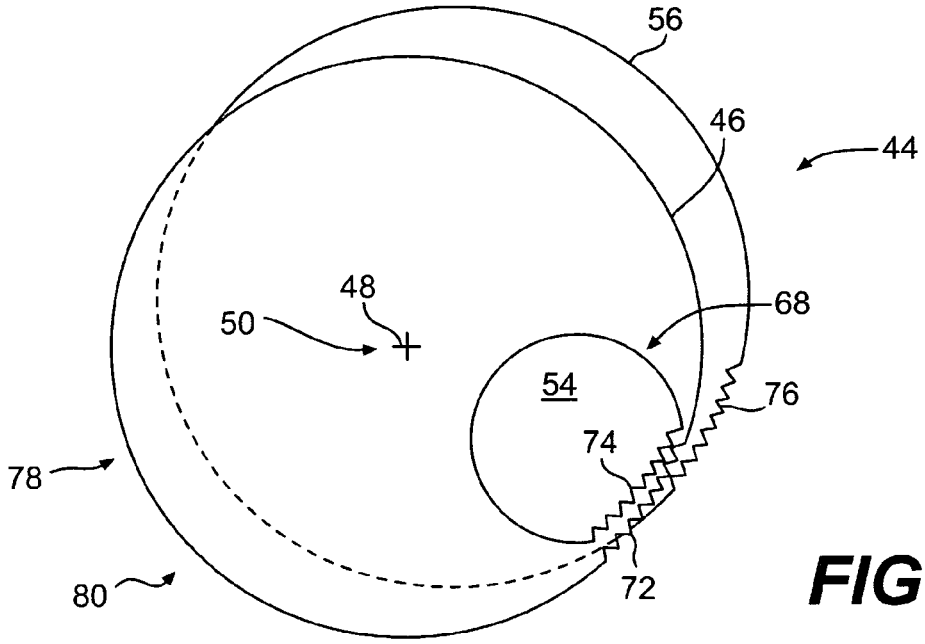
FIG. 5 is a diagrammatic view of a portion of another embodiment of the gear train of the internal combustion engine of FIG. 1.
Figure 6:
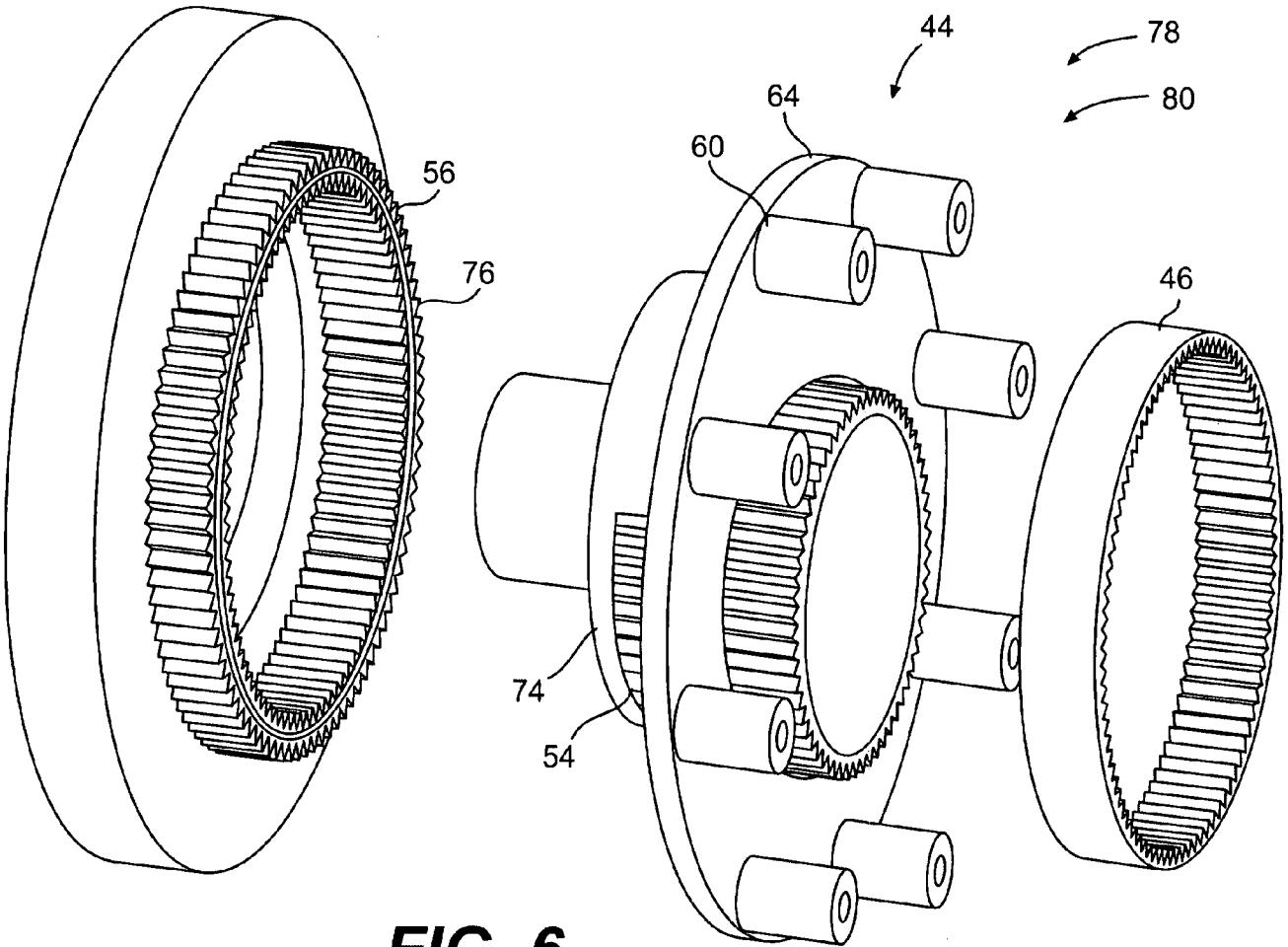
FIG. 6 is an exploded view of the portion of the embodiment of the gear train of FIG. 5.
Figure 7:
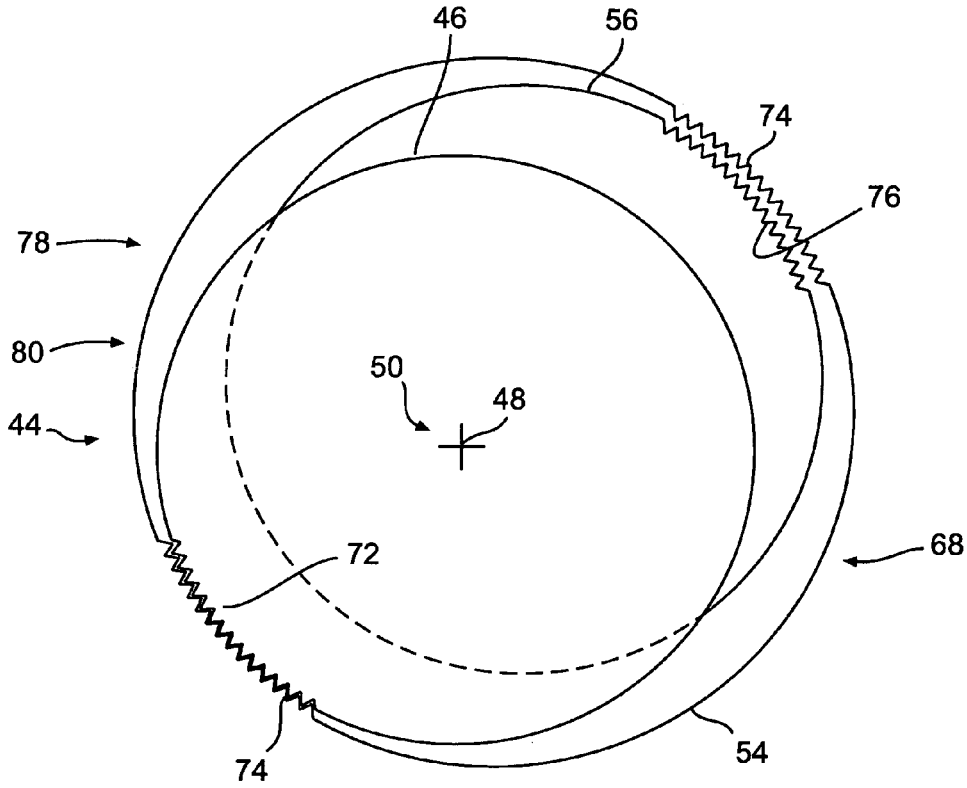
FIG. 7 is a diagrammatic view of a portion of another embodiment of the gear train of the internal combustion engine of FIG. 1.

The second gear 54 of the engine 10 is connected to the vcr mechanism 36. In the embodiments of FIGS. 4 and 6, the second gear 54 is connected to the vcr mechanism 36 via a vcr connection device 60. In FIG. 4, the vcr connection device 60 is an arm 62. The arm 62 protrudes from the vcr mechanism 36. In FIG. 6, an exploded view of the embodiment of the gear train 44 of FIG. 5, the vcr connection device 60 is a carrier 64. In the embodiment of the carrier 64 in FIG. 6, the carrier 64 surrounds the second gear 54. Referring to FIG. 2, the second gear 54 has an axis 66. The axis 66 is moveable between a first position 68, one embodiment of which is shown in FIG. 2, at which the vcr mechanism 36 is at the first mechanism position 38 and the axis 48 of the first gear 46 is at its first position 50, and a second position 70, one embodiment of which is shown in FIG. 3, at which the vcr mechanism 36 is at the second mechanism position 40 and the axis 48 of the first gear 46 is at its second position 52. FIGS. 5 through 7, described in more detail below, illustrate different embodiments of the first gear 46, second gear 54, and third gear 56 of the gear train 44. One of ordinary skill in the art will recognize that the first position 68 of the second gear 54 and the second position 70 of the second gear 54 may differ from one embodiment to another.

In the embodiments of the gear train 44 of FIGS. 2 through 7, the first gear 46 has a plurality of teeth 72, the second gear 54 has a plurality of teeth 74, and the third gear 56 has a plurality of teeth 76. In some of the Figs., the pluralities of teeth, 72, 74, and 76 are shown only on part of the circumferences of the first gear 46, the second gear 54, and the third gear 56. However, the pluralities of teeth, 72, 74, and 76 may extend around the entire circumferences of the gears, 46, 54 and 56. In some embodiments, such as those shown in FIGS. 5 through 7, at least one of the pluralities of teeth 72, 74, and 76 of the first gear 46, the second gear 54, and the third gear 56 are internal teeth. As used herein, the term "internal teeth" means teeth that are located on a surface spaced apart from a center of a gear and that protrude from that surface in a direction generally towards the center of the gear. One example of a gear that often has internal teeth is a ring gear. In other embodiments of the gear train 44, such as that shown in FIGS. 2 through 4, the first gear 46, second gear 54, and third gear 56 all have external teeth. As used herein, the term "external teeth" means teeth that are located on a surface spaced apart from a center of a gear and that protrude from that surface in a direction generally away from the center of the gear.

In the embodiment of FIG. 5, the first gear 46 and the third gear 56 each have a plurality of internal teeth, 72 and 76, and the second gear 54 has a plurality of external teeth 74. The second gear 54 is smaller than the first gear 46 and the third gear 56, and the second gear 54 is located within the outer circumferences of both the first gear 46 and the third gear 56. In the embodiment of FIG. 5, the axis 48 of the first gear 46 is in its first position 50. The axis 48 of the first gear 46 is moveable to its second position 52, not shown, that is similar to the second position 52 of the axis 48 of the first gear 46 in the embodiment of FIG. 3. In FIG. 5, the second gear 54 is in its first position 68. The second gear 54 is moveable to its second position 70, not shown, when the first gear 46 is in its second position 52, such that the mesh between the first gear 46, the second gear 54, and the third gear 56 is maintained. FIG. 6 shows an exploded view of the embodiment of FIG. 5.

In the embodiment of FIG. 7, the first gear 46 and the third gear 56 have a plurality of external teeth, 72 and 76, and the second gear 54 has a plurality of internal teeth 74. The second gear 54 is larger than the first gear 46 and the third gear 56, and the first gear 46 and the third gear 56 are located within the outer circumference of the second gear 54. In the embodiment of FIG. 7, the axis 48 of the first gear 46 is in its first position 50. The axis 48 of the first gear 46 is moveable to its second position 52, not shown, that is similar to the second position 52 of the axis 48 of the first gear 46 in the embodiment of FIG. 3. In FIG. 7, the second gear 54 is in its first position 68. The second gear 54 is moveable to its second position 70, not shown, when the first gear 46 is in its second position 52, such that the mesh between the first gear 46, the second gear 54, and the third gear 56 is maintained. In an alternative embodiment of the gear train 44 of FIG. 7, the positions of the first gear 46 and the third gear 56 are switched.

At least one of the plurality of teeth 72 of the first gear 46 is in contact with at least one of the plurality of teeth 74 of the second gear 54. Also, at least one of the plurality of teeth 76 of the third gear 56 is in contact with at least one of the plurality of teeth 74 of the second gear 54. In the embodiment of FIGS. 2, 3 and 4, at least one of the plurality of teeth 74 of the second gear 54 is in simultaneous contact with at least one of the plurality of teeth 72 of the first gear 46 and at least one of the plurality of teeth 76 of the third gear 56. However, in other embodiments of the gear train 44, the at least one of the plurality of teeth 74 of the second gear 54 that is in contact with the at least one of the plurality of teeth 72 of the first gear 46 may be different than the at least one of the plurality of teeth 72 of the second gear 54 that is in contact with the at least one of the plurality of teeth 76 of the third gear 56.

The engine 10 includes a means for sustaining 78 a driving relationship between the crankshaft 22 and the gear train 44 of the engine 10. In the embodiments of FIGS. 2 through 7, the means for sustaining 78 includes the first gear 46, the second gear 54, and the third gear 56. The engine 10 also includes a means for maintaining 80 a timing relationship between the crankshaft 22 and the camshaft 58. In the embodiments of FIGS. 2 through 7, the means for maintaining 80 includes the first gear 46, the second gear 54, and the third gear 56.

INDUSTRIAL APPLICABILITY

During operation of the engine 10, combustion of a fuel and air mixture within the cylinder 16 of the engine 10 forces the piston 18 to push the connecting rod 20 toward the crankshaft 22. The force of the connecting rod 20 upon the crankshaft 22 causes the crankshaft 22 to rotate and drive the gear train 44 of the engine 10. When a certain compression ratio of the engine 10 is desired, the crankshaft 22 is placed in the first crankshaft position 26. When a greater compression ratio is desired, the means for moving 34 the axis 24 of the crankshaft 22 acts upon the crankshaft 22 to place it in the second crankshaft position 30.

Explanation of the general operation of the first gear 46, second gear 54, and third gear 56 of the embodiments of the gear train 44 illustrated in FIGS. 2 through 7 will be accomplished by focusing on the embodiment of the gear train 44 shown in FIGS. 2 through 4. In FIG. 2, the crankshaft 22 is in the first crankshaft position 26. The primary rotation of the crankshaft 22, illustrated by arrow 82, caused by the force of the connecting rod 20 drives the first gear 46 in the direction illustrated by arrow 82. The second gear 54 is driven by the first gear 46 via the at least one of the plurality of teeth 72 of the first gear 46 that is in contact with the at least one of the plurality of teeth 74 of the second gear 54. This driving force of the first gear 46 causes the second gear 54 to rotate in the direction illustrated by arrow 84. The second gear 54 drives the third gear 56 of the gear train 44 via the at least one of the plurality of teeth 74 of the second gear 54 that is in contact with the at least one of the plurality of teeth 76 of the third gear 56. The third gear 56 is driven in the direction illustrated by arrow 86. The third gear 56 drives the rest of the gear train 44 of the engine 10 and, therefore, drives the camshaft 58 of the engine 10.

When a greater compression ratio is desired, the means for moving 34 the axis 24 of the crankshaft 22 from the first crankshaft position 26 to the second crankshaft position 30, i.e. the vcr mechanism 36 in the embodiments of FIGS. 2 through 4, acts upon the crankshaft 22 and moves the axis 24 of the crankshaft 22 to the second crankshaft position 30. In the embodiments of FIGS. 2 and 3, the axis 24 of the crankshaft 22 is moved by rotation of the vcr mechanism 36. However, in other embodiments, the vcr mechanism 36 may move the crankshaft 22 via other processes.

As the crankshaft 22 moves from the first crankshaft position 26 to the second crankshaft position 30, the first gear 46 moves from the first position 50 to the second position 52. In addition, the second gear 54, which is attached to the vcr mechanism 36, is moved from its first position 68 to its second position 70. Throughout the movement of the first gear 46 and the second gear 54 from their respective first positions, 50 and 68, to their respective second positions, 52 and 70, the mesh between the first gear 46, the second gear 54, and the third gear 56 is maintained. Thus, a driving relationship is sustained between the crankshaft 22 and the gear train 44.

In addition, as the axis 24 of the crankshaft 22 is moved from the first crankshaft position 26 to the second crankshaft position 30, a timing relationship between the crankshaft 22 and the camshaft 58 is maintained. In internal combustion engines 10 in which the camshaft 58 is driven by the crankshaft 22, the timing between the crankshaft 22 and the camshaft 58 is controlled such that the camshaft rotates a certain number of times for every rotation of the crankshaft 22. A common ratio is one camshaft 58 rotation for every two crankshaft 22 rotations. Maintaining this timing relationship is crucial because the camshaft 58 controls the opening and closing of intake and exhaust valves of the engine 10. If the timing relationship is disturbed, the camshaft 58 may open a valve too early or leave it open too long such that the piston 18 may collide with the valve, causing damage to the piston 18, the valve, or both. If the crankshaft 22 were connected to the gear train 44 solely by a spur gear that is mounted on the crankshaft 22, is moveable in an arc, and is meshed with a ring gear having internal teeth and a fixed center of rotation, the interrelation of the ring gear and the spur gear would cause a secondary rotation of the crankshaft 22. As used herein, secondary rotation of the crankshaft 22 refers to rotation of the crankshaft 22 that occurs during the movement of the crankshaft 22 between the first crankshaft position 26 and the second crankshaft position 30 and that is not caused by forces applied to the crankshaft 22 by one or more connecting rods 20 or a flywheel of the engine 10. This secondary rotation is not passed through the gear train 44 to the camshaft 58 and, therefore, causes the timing relationship between the crankshaft 22 and the camshaft 58 to be disrupted. In the embodiments of FIG. 2 through 7, secondary rotation of the crankshaft 22 as it is moved from the first crankshaft position 26 to the second crankshaft position 30 is prevented. This prevention is accomplished by the interrelationship of the first gear 46, the second gear 54, and the third gear 56.

Operation of the embodiments of the gear train 44 shown in FIGS. 5 through 7 is similar to the operation described above of the embodiment of the gear train in FIGS. 2 through 4. One of ordinary skill in the art will recognize that the relative positions of the first gear 46, the second gear 54, and the third gear 56 may differ from one embodiment to another. In addition, one of ordinary skill in the art will recognize that during operation of the engine 10 of the present invention the axis 24 of the crankshaft 22 may be moved from the first crankshaft position 26 to any position between the first crankshaft position 26 and the second crankshaft position 30, inclusive. In addition, the crankshaft 22 may be moved from the second crankshaft position 30 to any position between the second crankshaft position 30 and the first crankshaft position 26, inclusive.

Other aspects, objects, and advantages of this invention can be obtained from a study of the drawings, the disclosure, and the appended claims.

What is claimed is:

1. An internal combustion engine, comprising:
a cylinder block defining a cylinder;
a piston reciprocally disposed in said cylinder;
a connecting rod connected to said piston;
a crankshaft connected to said connecting rod;
a vcr mechanism connected to said crankshaft;
a first gear connected to said crankshaft;
a second gear in mesh with said first gear, said second gear being connected to said vcr mechanism; and
a third gear in mesh with said second gear, said third gear having a fixed center of rotation.

2. The internal combustion engine of claim 1 wherein:
said cylinder block has a top surface; and
said crankshaft has an axis, said crankshaft being moveable between a first crankshaft position at which said axis is a first defined distance from said top surface of said cylinder block and a second crankshaft position at which said axis is a second defined distance from said top surface of said cylinder block.

3. The internal combustion engine of claim 2 wherein:
said vcr mechanism is moveable between a first mechanism position at which said crankshaft is at said first crankshaft position and a second mechanism position at which said crankshaft is at said second crankshaft position; and
said second gear has an axis, said axis of said second gear being moveable between a first position at which said vcr mechanism is at said first mechanism position and a second position at which said vcr mechanism is at said second mechanism position.

4. The internal combustion engine of claim 1 including a vcr connection device located to connect said vcr mechanism to said second gear.

5. The internal combustion engine of claim 4 wherein said vcr connection device is an arm.

6. The internal combustion engine of claim 4 wherein said vcr connection device is a carrier.

7. The internal combustion engine of claim 1 wherein:
said first gear has a plurality of teeth;
said third gear has a plurality of teeth; and
said second gear has a plurality of teeth, at least one of said plurality of teeth of said second gear being in simultaneous contact with at least one of said plurality of teeth of said first gear and at least one of said plurality of teeth of said third gear.

8. The internal combustion engine of claim 1 wherein:
said first gear has a plurality of external teeth, said second gear has a plurality of external teeth, at least one of said plurality of teeth of said second gear being in contact with at least one of said plurality of teeth of said first gear, and
said third gear has a plurality of external teeth, at least one of said plurality of teeth of said third gear being in contact with at least one of said plurality of teeth of said second gear.

9. The internal combustion engine of claim 1 wherein at least one of said first gear, said second gear, and said third gear has a plurality of internal teeth.

10. The internal combustion engine of claim 9 wherein:
said first gear has a plurality of internal teeth,
said second gear has a plurality of external teeth, at least one of said plurality of teeth of said second gear being in contact with at least one of said plurality of teeth of said first gear, and
said third gear has a plurality of internal teeth, at least one of said plurality of teeth of said third gear being in contact with at least one of said plurality of teeth of said second gear.

11. The internal combustion engine of claim 9 wherein:
said first gear has a plurality of external teeth;
said second gear has a plurality of internal teeth, at least one of said plurality of teeth of said second gear being in contact with at least one of said plurality of teeth of said first gear, and
said third gear has a plurality of external teeth, at least one of said plurality of teeth of said third gear being in contact with at least one of said plurality of teeth of said second gear.

12. The internal combustion engine of claim 1 wherein said vcr mechanism includes a crankshaft cradle.

13. The internal combustion engine of claim 1 including a camshaft operatively connected to said third gear.

14. A gear train for an internal combustion engine, said internal combustion engine having a crankshaft and a vcr mechanism connected to said crankshaft, said gear train comprising:
a first gear connected to said crankshaft;
a second gear in mesh with said first gear, said second gear being connected to said vcr mechanism; and
a third gear in mesh with said second gear, said third gear having a fixed center of rotation.

15. The gear train of claim 14 wherein:
said first gear has an axis, said axis of said first gear being moveable between a first position and a second position; and
said second gear has an axis, said axis of said second gear being moveable between a first position at which said axis of said first gear is at said first position and a second position at which said axis of said first gear is at said second position.

16. The gear train of claim 14 wherein:
said first gear has a plurality of teeth;
said third gear has a plurality of teeth; and
said second gear has a plurality of teeth, at least one of said plurality of teeth of said second gear being in contact with at least one of said plurality of teeth of said first gear and at least one of said plurality of teeth of said third gear.

17. The gear train of claim 14 wherein:

said first gear has a plurality of external teeth, said second gear has a plurality of external teeth, at least one of said plurality of teeth of said second gear being in contact with at least one of said plurality of teeth of said first gear, and said third gear has a plurality of external teeth, at least one of said plurality of teeth of said third gear being in contact with at least one of said plurality of teeth of said second gear.

18. The gear train of claim 14 wherein at least one of said first gear, said second gear, and said third gear has a plurality of internal teeth.

19. The gear train of claim 18 wherein:

said first gear has a plurality of internal teeth, said second gear has a plurality of external teeth, at least one of said plurality of teeth of said second gear being in contact with at least one of said plurality of teeth of said first gear, and said third gear has a plurality of internal teeth, at least one of said plurality of teeth of said third gear being in contact with at least one of said plurality of teeth of said second gear.

20. The gear train of claim 18 wherein:

said first gear has a plurality of external teeth;

said second gear has a plurality of internal teeth, at least one of said plurality of teeth of said second gear being in contact with at least one of said plurality of teeth of said first gear, and said third gear has a plurality of external teeth, at least one of said plurality of teeth of said third gear being in contact with at least one of said plurality of teeth of said second gear.

21. A method of operating an internal combustion engine having a crankshaft, a gear train connected to said crankshaft, and a camshaft connected to said gear train, said crankshaft having an axis, said method comprising:

moving said axis of said crankshaft from a first position to a second position;

sustaining a driving relationship between said crankshaft and said gear train; and maintaining a timing relationship between said crankshaft and said camshaft.

22. The method of claim 21 wherein said maintaining includes preventing secondary rotation of said crankshaft.

23. The method of claim 22 wherein said preventing is accomplished by a second gear acting upon said first gear.

24. The method of claim 23 including moving an axis of said second gear from a first position to a second position.

25. The method of claim 24 including meshing said second gear with a third gear, said third gear having a fixed center of rotation, said third gear being operatively connected to said camshaft.

26. An internal combustion engine, comprising:

a cylinder block defining a cylinder;

a piston reciprocally disposed in said cylinder;

a connecting rod connected to said piston;

a crankshaft connected to said connecting rod, said crankshaft having an axis;

a gear train connected to said crankshaft;

a camshaft connected to said gear train;

means for moving said axis of said crankshaft from a first position to a second position;

means for sustaining a driving relationship between said crankshaft and said gear train; and means for maintaining a timing relationship between said crankshaft and said camshaft.

* * * * *